US006825451B1

(12) United States Patent
Deangelis

(10) Patent No.: US 6,825,451 B1
(45) Date of Patent: Nov. 30, 2004

(54) MICROWAVABLE DEFROSTING APPARATUS

(76) Inventor: Mark T. Deangelis, 24 Jackson St., Boscawen, NH (US) 03303

( * ) Notice: Subject to any disclaimer, the term of this patent is extended or adjusted under 35 U.S.C. 154(b) by 0 days.

(21) Appl. No.: 10/794,293

(22) Filed: Mar. 8, 2004

(51) Int. Cl.[7] ..... H05B 6/80

(52) U.S. Cl. ..... 219/679; 219/203; 219/703; 219/720; 219/759

(58) Field of Search ..... 219/679, 687, 219/703, 720, 730–735, 759, 762, 203

(56) References Cited

U.S. PATENT DOCUMENTS

D279,818 S 7/1985 Douglas
4,743,726 A 5/1988 Hughes et al.
4,849,593 A 7/1989 Hughes et al.
4,920,964 A 5/1990 Francis, Jr.
4,931,608 A 6/1990 Bills
4,983,798 A * 1/1991 Eckler et al. ..... 219/730
5,029,662 A 7/1991 Pena
5,369,257 A * 11/1994 Gibbon ..... 219/759
6,610,969 B2 * 8/2003 Feher ..... 219/679

* cited by examiner

*Primary Examiner*—Philip H. Leung

(57) ABSTRACT

A microwave-heatable apparatus for defrosting a windshield includes a housing that has first and second sections integral with each other and selectively movable between open and closed positions. The first and second sections each has an elongated slot formed therein and for advantageously allowing air to flow upwardly therethrough respectively. The first and second sections each has a chamber defined about the respective slots thereof and a plurality of heat-absorbing members positioned within the chambers respectively for dissipating thermal energy so that as air passes upwardly through the slot the air will become heated.

13 Claims, 3 Drawing Sheets

MICROWAVABLE DEFROSTING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a microwave-heatable defrosting apparatus and, more particularly, to a portable microwave-heatable defrosting apparatus including a thermal gel pack positionable adjacent vehicle windows for melting snow/ice therefrom.

2. Prior Art

Heating of water to the boiling point requires a fairly long period of time as distinguished from the significantly shorter time of heating a gel pack by microwave energy as the pot or container for the pack must be fairly large for accommodating the pack without the pack touching the usual metal sides of the pot which would melt and damage the plastic envelope of the pack. This size pot would necessitate utilizing a large quantity of water thereby requiring a longer period of time for heating the water to its boiling point.

Furthermore, when heating a gel package in boiling water in a pan or pot on a heater unit, the pan would be at the highest temperature which would damage, as by melting the plastic, present packages as the operator has no control over the pan temperature. Additionally when utilizing a large pan containing a large volume of water, the gel pack contacted the sides and bottom of the pan which were at a higher temperature than the water thereby resulting in damage to the envelope of the gel-pack.

Accordingly, a need remains for a microwavable defrosting apparatus including a suitable thermal gel pack to overcome the above-noted shortcomings.

BRIEF SUMMARY OF THE INVENTION

In view of the foregoing background, it is therefore an object of the present invention to provide a microwavable defrosting pad. These and other objects, features, and advantages of the invention are provided by a microwave-heatable apparatus for defrosting a windshield wherein the apparatus includes a housing that has first and second sections integral with each other and selectively movable between open and closed positions.

The housing may have a substantially serpentine shape with a triangular cross-section, or may have an alternate non-linear shape with an annular cross-section, for example. Of course, alternate embodiments of the present apparatus are also possible to accommodate vehicles space limitations and therefore any particular shape of the present invention is not germane to its scope of novelty over the prior art of record.

The apparatus may further include a temperature-displaying member attached to either the first or second sections so that a user can advantageously monitor the temperature of the heat-retaining members. The first and second sections each has an elongated slot formed therein for advantageously allowing air to flow upwardly therethrough respectively. The present invention may further include a non-skid outer layer connected preferably to the bottom of the housing and for assisting to maintain the apparatus at a predetermined position.

The first and second sections each has a chamber defined about the respective slots thereof and a plurality of heat-absorbing members positioned within the chambers respectively for dissipating thermal energy so that as air passes upwardly through the slots the air will become heated to advantageously melt ice and snow away from a windshield. The plurality of heat-absorbing members may each comprise a solution preferably including approximately 1.0 to 10.0 percent water, approximately 0.5 to 5.0 percent sodium chloride, and approximately 85.0 to 99.0 percent hydroxypropyl methylcellulose.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
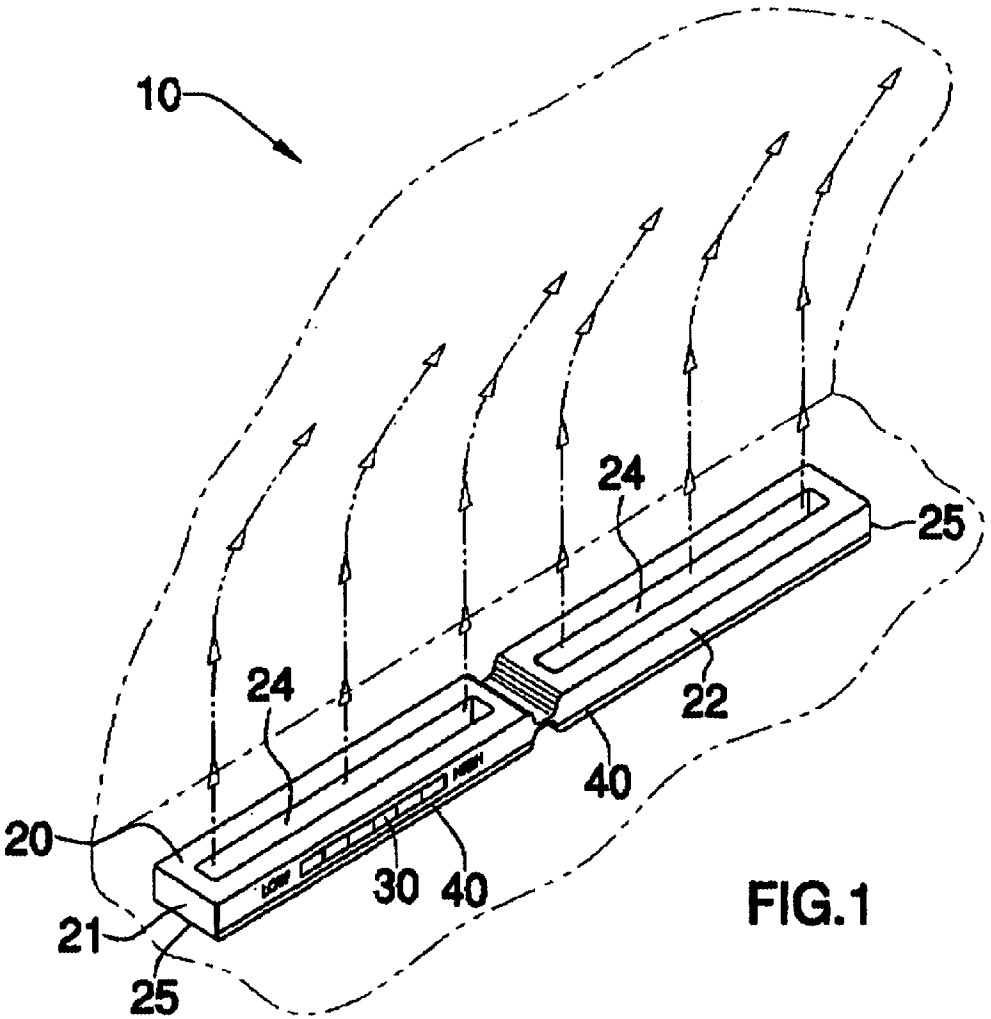
FIG. 1 is a perspective view showing a microwavable defrosting apparatus, in accordance with the present invention.
Figure 2:
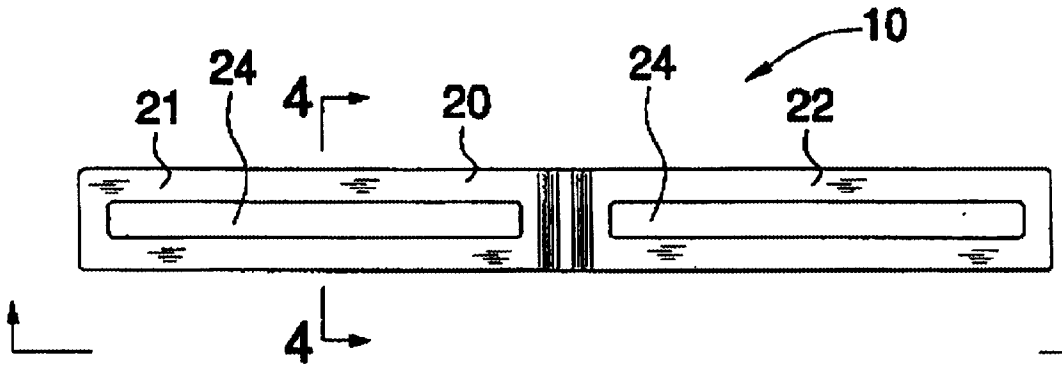
FIG. 2 is a top plan view of the apparatus shown in FIG. 1.
Figure 3:
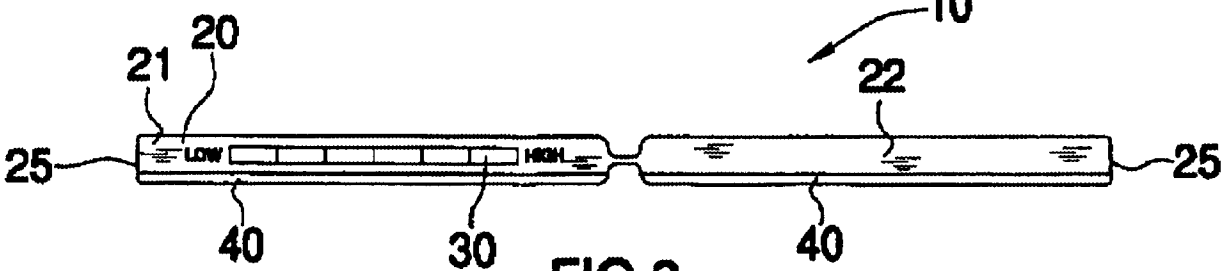
FIG. 3 is a front side elevational view of the apparatus shown in FIG. 1.
Figure 4:
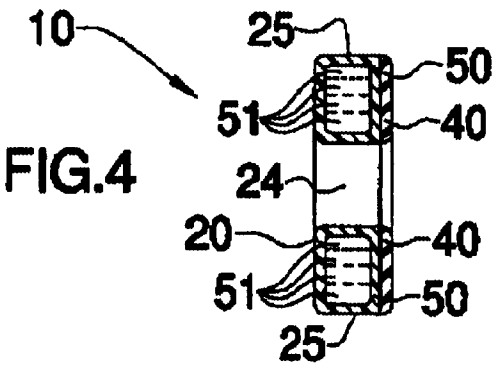
FIG. 4 is a cross-sectional view of the apparatus shown in FIG. 2, taken along line 4—4.
Figure 5:
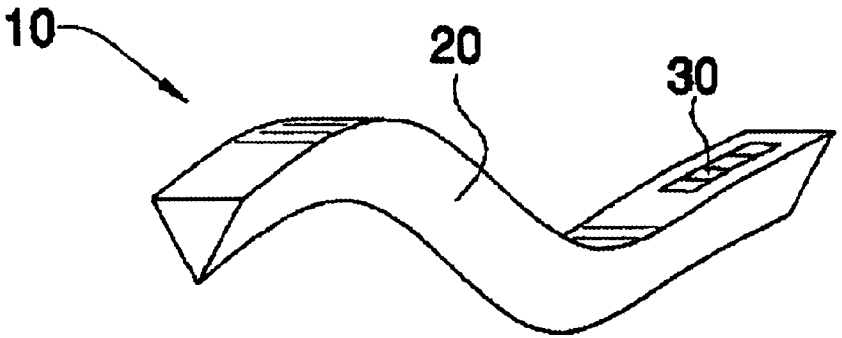
FIGS. 5 and 6 are perspective views showing alternate embodiments of the apparatus shown in FIG. 1.
Figure 6:
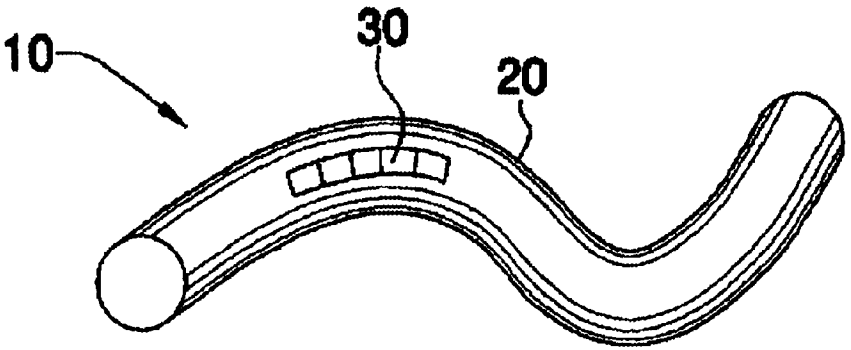

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements and prime notations refer to alternate embodiments throughout the figures.

The apparatus of this invention is referred to generally in FIGS. 1–6 by the reference numeral 10 and is intended to provide a microwavable defrosting apparatus for vehicle windshields. It should be understood that the apparatus 10 may be used to heat many different surfaces and should not be limited to only heating vehicle windshields.

Referring initially to FIG. 1, the apparatus 10 includes a housing 20 that has first 21 and second 22 sections integral with each other and selectively movable between open and closed positions, allowing for easy storage in, for example, a glove compartment box.

The housing 20 can have a substantially serpentine shape with a triangular cross-section, or can have an alternate non-linear shape with an annular cross-section, for example. Of course, alternate embodiments of the present apparatus 10 are also possible to accommodate vehicles space limitations and therefore any particular shape of the present invention is not germane to its scope of novelty over the prior art of record.

The apparatus 10 further includes a temperature-displaying member 30 attached to either the first 21 or second 22 sections so that a user can advantageously monitor the temperature of the heat-retaining members 51. The first 21 and second 22 sections each have an elongated slot 24 formed therein for advantageously allowing air to flow upwardly therethrough respectively. The present invention further includes a non-skid outer layer 40 connected preferably to the bottom 25 of the housing and for assisting to maintain the apparatus 10 at a predetermined position.

The first 21 and second 22 sections each has a chamber 50 defined about the respective slots thereof and a plurality of heat-absorbing members 51 positioned within the chambers 50 respectively for dissipating thermal energy so that as air passes upwardly through the slots 24 the air will become heated to advantageously melt ice and snow away from a windshield. This effectively eliminates the inconvenient and time consuming practice of manually scraping ice from a glass windshield, or having to wait for the automobile's air conditioning system to heat up. The plurality of heat-absorbing members 51 each comprise of a solution including approximately 1.0 to 10.0 percent water, approximately 0.5 to 5.0 percent sodium chloride, and approximately 85.0 to 99.0 percent hydroxypropyl methylcellulose.

The appealing features of the apparatus 10 are its simple design, effectiveness and safety. The apparatus 10 provides instant heat where needed that saves time and effort in the winter so the vehicle is prepared faster for travel. The apparatus 10 helps ensure full forward visibility for the driver, thereby enhancing safety and preventing unnecessary stress and anxiety when traveling in cold winter weather.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A microwave-heatable apparatus for defrosting a windshield and comprising:

a housing having first and second sections integral with each other and selectively movable between open and closed positions, said first and second section each having an elongated slot formed therein and for allowing air to flow upwardly therethrough respectively, said first and second sections each having a chamber defined about the respective slots thereof; and a plurality of microwave responsive heat-absorbing members positioned within said chambers respectively and for dissipating thermal energy so that as air passes upwardly through said slot the air will become heated to melt ice and snow away from a windshield.

2. The apparatus of claim 1, wherein said plurality of heat-absorbing members each comprise a solution comprising:

approximately 1.0 to 10.0 percent water;

approximately 0.5 to 5.0 percent sodium chloride; and approximately 85.0 to 99.0 percent hydroxypropyl methylcellulose.

3. The apparatus of claim 1, further comprising: a non-skid outer layer connected to said housing and for assisting to maintain said apparatus at a predetermined position.

4. The apparatus of claim 1, wherein said housing has a substantially serpentine shape and a triangular cross-section.

5. The apparatus of claim 1, wherein said housing has a non-linear shape and an annular cross-section.

6. A microwave-heatable apparatus for defrosting a windshield and comprising:

a housing having first and second sections integral with each other and selectively movable between open and closed positions, said first and second section each having an elongated slot formed therein and for allowing air to flow upwardly therethrough respectively, said first and second sections each having a chamber defined about the respective slots thereof;

a plurality of microwave responsive heat-absorbing members positioned within said chambers respectively and for dissipating thermal energy so that as air passes upwardly through said slot the air will become heated to melt ice and snow away from a windshield; and a temperature-displaying member attached to one said first and second sections so that a user can monitor the temperature of said heat-retaining members.

7. The apparatus of claim 6, wherein said plurality of heat-absorbing members each comprise a solution comprising:

approximately 1.0 to 10.0 percent water;

approximately 0.5 to 5.0 percent sodium chloride; and approximately 85.0 to 99.0 percent hydroxypropyl methylcellulose.

8. The apparatus of claim 6, wherein said housing has a substantially serpentine shape and a triangular cross-section.

9. The apparatus of claim 6, wherein said housing has a non-linear shape and an annular cross-section.

10. A microwave-heatable apparatus for defrosting a windshield and comprising:

a housing having first and second sections integral with each other and selectively movable between open and closed positions, said first and second section each having an elongated slot formed therein and for allowing air to flow upwardly therethrough respectively, said first and second sections each having a chamber defined about the respective slots thereof;

a plurality of microwave responsive heat-absorbing members positioned within said chambers respectively and for dissipating thermal energy so that as air passes upwardly through said slot the air will become heated to melt ice and snow away from a windshield;

a temperature-displaying member attached to one said first and second sections so that a user can monitor the temperature of said heat-retaining members; and a non-skid outer layer connected to said housing and for assisting to maintain said apparatus at a predetermined position.

11. The apparatus of claim 10, wherein said plurality of heat-absorbing members each comprise a solution comprising:

approximately 1.0 to 10.0 percent water;

approximately 0.5 to 5.0 percent sodium chloride; and approximately 85.0 to 99.0 percent hydroxypropyl methylcellulose.

12. The apparatus of claim 10, wherein said housing has a substantially serpentine shape and a triangular cross-section.

13. The apparatus of claim 10, wherein said housing has a non-linear shape and an annular cross-section.

* * * * *